United States Patent [19]

Douchy

[11] Patent Number: 4,863,803

[45] Date of Patent: Sep. 5, 1989

[54] COMPOSITE PRODUCT WITH A TUBULAR CASING FOR TREATING MOLTEN METAL BATHS

[75] Inventor: Michel Douchy, Solesmes, France

[73] Assignee: Affival, France

[21] Appl. No.: 148,435

[22] Filed: Jan. 26, 1988

[30] Foreign Application Priority Data

Feb. 3, 1987 [FR] France ..... 87 01433

[51] Int. Cl.[4] ..... B22F 3/00

[52] U.S. Cl. ..... 420/552; 428/554; 428/557; 428/558; 419/8; 419/9

[58] Field of Search ..... 428/552, 554, 557, 558; 419/8, 9

[56] References Cited

U.S. PATENT DOCUMENTS 4,531,982 7/1985 Dubots ..... 148/11.5 F

*Primary Examiner*—Stephen J. Lechert, Jr.

*Attorney, Agent, or Firm*—Jones, Day, Reavis & Pogue

[57] ABSTRACT

The invention relates to a composite product of substantial length for the treatment of metal baths which is formed by a tubular metal casing (2) within which are housed the treatment material or materials in powder form and which comprises an axial zone (4) containing a first material surrounded by a tubular metal intermediate wall (3) and an annular zone (6) between the casing and the intermediate wall and which also contains a second material.

Such a composite product in which the axial zone contains at least one element selected from calcium and magnesium can be used in particular for the desulphurization of iron or steel baths.

8 Claims, 1 Drawing Sheet

COMPOSITE PRODUCT WITH A TUBULAR CASING FOR TREATING MOLTEN METAL BATHS

Figure 1:
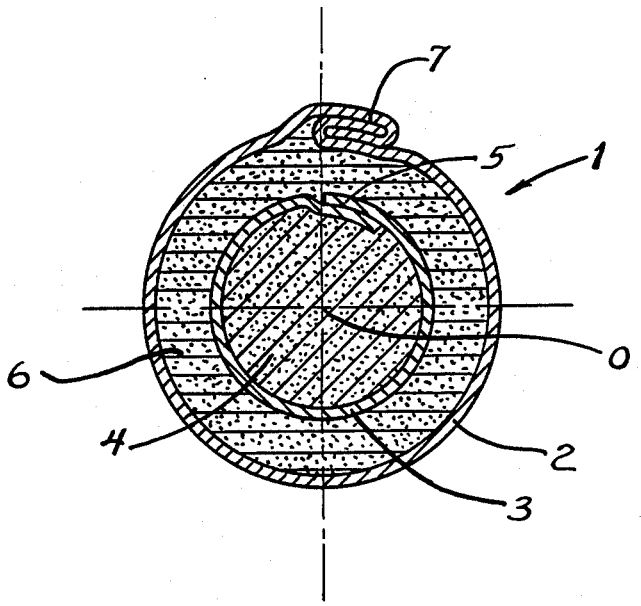

The present invention concerns a composite product with a tubular casing for treating metal baths and a process for using that product.

A composite product for treating molten metal baths is known, being described in French utility certificate No. 2 433 584. That composite product, which is referred to as a sheathed wire in that document, comprises in particular a metal sheath or casing formed by a thin strip of substantial length, the edges of which are curved round in such a way that the edges are brought together or welded to produce a substantially circular section. Housed within the sheath is a material in granular or powder form such as for example a powder of Ca-Si alloy. Such a sheathed wire which is 12 mm in diameter with a sheath thickness of 0.5 mm is introduced for example into a ladle containing liquid steel, at a speed of 2 meters per second (French No. 2 433 584, page 4).

Experience has shown that in many cases, in order for the treatment of the liquid metal to attain its full effectiveness, it must be possible for the content of the sheathed wire to be introduced into the metal bath as far as the bottom of the ladle containing it. It is also necessary for the content of the sheathed wire to be freed from its casing at the moment at which it is in the vicinity of the bottom of the ladle. If the casing is prematurely destroyed, for example due to very rapid fusion as soon as it passes into the metal bath, the content thereof is liberated in the vicinity of the surface of the bath. In other circumstances, it is possible to observe relatively slow dissolution of the casing as it penetrates into the metal bath. However, at the temperature to which it is raised, the casing loses all rigidity and progressively curves into a U-shape so that the end thereof rises to the surface again before the content of the sheathed wire is discharged therefrom. Such an upward movement of the end of the casing is due in particular to hydrostatic thrust or buoyancy; indeed, the apparent density of the composite product is generally considerably less than that of the metal bath.

When treating for example a steel bath in a ladle using a composite product with a steel casing, which is introduced into the bath approximately vertically, the depth of penetration depends on the thickness of the casing and the speed at which the composite product is introduced, but the residence time is very short as, as soon as the casing reaches its melting temperature, it is virtually instantly dissolved.

When the content of the sheathed wire is formed by lowvolatility additive elements such as Si, Mn and Ti, premature liberation thereof does not suffer from major disadvantages. In contrast, when using highly volatile elements such as Ca or Mg, liberation thereof at a shallow depth gives rise to very substantial losses in efficiency. The phenomenon of premature fusion of the casing is observed in a particularly striking manner when the casing has a melting temperature which is very much lower than the temperature of the metal bath. That is the case for example when treating liquid steel by means of a composite product with an aluminum casing.

It has also been found that the use of a composite product whose casing has a melting temperature which is higher than the temperature of the metal bath also involves serious disadvantages. Indeed, in that situation, even if the casing is thin, it is not possible to observe a virtually immediate fusion phenomenon as from the moment at which the temperature of the casing has approached that of the metal bath. All that is observed is progressive dissolution. The choice of a thickness such that dissolution is complete only when the sheathed wire has attained a given depth, having regard to the speed at which the composite product is introduced, terminated in failure. Indeed, the casing having lost all rigidity, the sheathed wire curves into a U-shape and rises towards the surface of the bath again, before having discharged its content.

Research was also carried on into the possibility of producing a composite product which retains a sufficient degree of rigidity to permit at least a part of the components thereof to be introduced into a metal bath in the vicinity of the bottom of the vessel containing same and which also makes it possible to liberate the same part of its components in as complete a fashion as possible, in the vicinity of the bottom of the vessel, without the composite product rising towards the surface of the bath again.

Research was also carried on into the possibility of producing a composite product which makes it possible for a predetermined part of its content to be discharged into the liqud metal bath at relatively shallow depth, with the remainder of the content being discharged at a greater depth and preferably in the vicinity of the bottom of the vessel.

Finally, research was also made into the possibility of developing a method of desulphurizing steels and cast irons, using such a composite product.

The composite product the subject-matter of the invention makes it possible to provide for depth treatment of metal baths.

The method which is also subject-matter of the invention makes it possible in particular to desulphurize steel of cast iron baths, with a particularly high level of efficiency, by virtue of the content of the composite product being liberated in two successive steps in the course of its penetration into such baths.

The composite product is composed of a tubular metal casing of substantial length, within which are housed the material or materials in powder or granular form for the treatment of molten metal baths, said product being introduced into such metal baths.

Within the tubular casing, the composite product comprises an axial zone containing at least one first material in powder or grandular form, surrounded by an intermediate tubular metal wall. An annular zone between the intermediate tubular wall and the tubular casing also contains at least one second material in powder or granular form.

The casing and the intermediate wall are made of metals which are compatible with the bath to be treated.

Preferably, the casing and likewise the intermediate wall will be of a substantially circular shape.

Depending on circumstances, the tubular casing and the intermediate wall may be made either of the same metal or of different metals, the nature of the metal or metals being compatible with the bath to be treated and the thickness of the casing and the wall being determined in dependence on the conditions corresponding to each situation in use. For example, to treat steel or iron baths, steel may be used as the casing and/or intermediate wall.

Advantageously also, at least the axial zone of the composite product contains at least one element selected from calcium and magnesium, in alloyed or non-alloyed form.

If appropriate, all or part of the second material in powder or granular form may be of the same composition as the first material in powder or granular form. However, such a case will generally be fairly rare.

The invention also concerns a method of treating metal baths by means of the product according to the invention. Advantageously, the composition of the first and second powder or grandular materials is adjusted in such a way that the axial zone contains at least for the major part the material or materials which is or are most highly reactive or most volatile with respect to the bath to be treated.

The method is applied in particular to the desulphurization treatment of steels and irons. Those metals are advantageously treated by means of the composite product according to the invention, at least the axial zone thereof containing magnesium and/ or calcium in an alloyed or non-alloyed state.

Advantageously, the annular zone of the same composite product contains one or more materials providing a complementary desulphurization effect such as for example MgO, CaO, $CaCO_3$ $Na_2$ $CO_3$ or $CaC_2$ in powder or granular form. Preferably the complementary desulphurization material is associated with aluminum, in granular or nongranular form. The second material which is contained in the annular zone may also comprise complementary substances for compensating for the elements of the metal bath which dissapear when carrying out a thorough desulphurization of the metal, such as for example silicon.

The composite product according to the invention may be produced by any method which is known to the man skilled in the art. It is possible in a first phase to produce the axial zone of the composite product, which is surrounded by its intermediate wall, for example by using a strip in which the edges are brought together or hooked together or overlap each other. Then, in a second phase, it is possible to produce the external tubular casing which encloses its axial zone and its annular zone, the composite product which has been produced in the first phase being embedded in the material which will fill the annular zone, the assembly again being surrounded by a casing formed from a thin strip. As the man skilled in the art is aware, the edges of the strips forming the intermediate wall and the casing may be closed by any known method compatible with the powder or granular materials used; the edges may be brought together in edgewise relationship, they may be overlapped, they may be brought into hooking engagement with each other, or the like. It is also possible to envisage using weldless tubes, although the filling thereof is then more difficult. The material contained both in the axial zone and in the annular zone is preferably compacted by means which are also known such as compression, drawing or the like. It is possible in particular to use a method as described in European Pat. No. 34994 which involves deforming the casing with a constant perimeter so as to produce two parallel flattened zones.

Any other method may also be used.

Experience has shown that, by virtue of its particular structure, the product according to the invention retains a substantial level of rigidity in the course of penetration thereof into a metal bath. As long as the tubular casing is not destroyed by being dissolved, the material which fills the annular zone performs the function of an effective heat insulation which considerably slows down the rise in temperature of the intermediate wall. The intermediate wall therefore retains a substantial part of its mechanical characteristics. It thus co-operates with the content of the axial zone to withstand the forces which tend to cause flexural deformation thereof and also the hydrostatic thrust which tends to prevent it from penetrating more deeply into the metal bath. It is only from the moment at which the intermediate wall comes into direct contact with the metal bath, following dissolution or melting of the casing, that the temperature of the intermediate wall rises very rapidly and its mechanical characteristics collapse. By carrying out simple routine tests, the man skilled in the art can easily ascertain the preferred characteristics which should be imparted to the intermediate wall and to the casing, in dependence in particular on the composition of the metal bath, its density, its depth and its temperature. The casing must preferably be made of a metal whose melting temperature is at least equal to that of the metal of which the intermediate wall is formed. The sections of the axial zone and the annular zone are established in dependence on the respective volumes of the materials which are to be housed therein. The metal and the thickness of the casing must be so determmined that the time required for melting or complete dissolution thereof corresponds to the depth at which the material contained in the annular zone is to be liberated, having regard to the speed of penetration of the composite product into the metal bath.

The following example and the accompanying single FIGURE set forth in non-limiting manner a composite product according to the invention and a particular mode of use thereof.

The single FIGURE is a view in cross-section of the composite product according to the invention.

The single FIGURE shows a composite product 1 according to the invention, of substantially circular section with an axis as indicated at 0. It comprises an outside casing 2 of steel, with an outside diameter of 14 mm and and a thickness of 0.3 mm. The intermediate wall 3 of steel has an outside diameter of 9 mm and is 0.4 mm in thickness. The axial zone 4 contains grains of calcium is non-alloyed state, about 0.5 mm in diameter. The intermediate wall which is closed by the edges being in simple overlapping relationship at 5 has been slightly squeezed around its content by a reduction in its outside diameter of about 25% by passing it through a die. The annular zone 6 is filled with iron powder. The outside casing which is closed by hooking engagement at 7 is also squeezed around its content.

That composite product is used to treat 65 tonnes of liquid steel contained in a ladle at a temperature of 1580° C. to desulphurize the metal.

In comparison with a treatment carried out using a conventional sheathed wire consisting of a steel casing with an outside diameter of 9 mm and a thickness of 0.6 mm containing grains of non-alloyed calcium in the compacted state, introduced into the metal bath at a speed of 110 meters per minute and in respect of which the desulphurization effect achieved is 26% on average, it is found that the composite product described hereinbefore and in accordance with the invention gives a desulphurization effect of 46%, the speed of introduction into the bath being only 50 meters per minute and the bath treatment time being substantially the same.

That corresponds to amounts of calcium which are introduced into the bath of:

0.15 kg/T with the conventional sheathed wire, and 0.15 kg/T, with the composite product according to the invention.

By withdrawing the wire very rapidly after the injection operation was interrupted, it was possible to demonstrate that the composite product according to the invention as described hereinbefore does in fact go into the metal bath which is being treated in two phases corresponding to different depths.

For a speed of injection of 50 meters per minute, measurements made on a composite product which was removed from the bath make it possible to estimate the difference in height between the two points at which the outer tubular casing and the intermediate tubular wall go into the bath, at 50 to 60 centimeters. The value as measured on a product withdrawn from the bath very rapidly after the injection movement has been stopped is in fact smaller (30 centimeters) due to the fact that the calcium in the axial zone continues to burn in the free air for about a minute.

Study of the operating procedure shows that a large part of the calcium contained in the axial zone was liberated in the vicinity of the bottom of the ladle. That is demonstrated in particular by the relatively peaceful appearance of the reactions in the bath which take place without steel being splashed or sprayed out of the ladle, when the wire according to the invention and of the above-described composition is introduced thereinto.

A very large number of modes of carrying into effect the product and the process according to the invention may be used without departing from the scope thereof.

I claim:

1. A composite product with a metal tubular casing of substantial length within which are housed the material or materials in powder or granular form used for the treatment of metal baths into which said composite product is introduced, the product comprising an axial zone containing at least one first material in powder or granular form, the first material being surrounded by a tubular metal intermediate wall, and an annular zone between the intermediate tubular wall and the casing containing at least one second material in powder or granular form.

2. A composite product according to claim 1 characterised in that the casing is of circular shape.

3. A composite product according to claim 1 characterised in that the casing is made of a metal whose melting temperature is at least equal to that of the metal forming the intermediate wall.

4. A composite product according to claim 3 characterised in that the casing and the intermediate wall are made of the same metal.

5. A composite product accordng to claim 3 characterised in that the casing and the intermediate wall are made of a different metal.

6. A composite product according to claim 1 characterised in that at least the axial zone contains at least one element selected from calcium and magnesium in alloyed or non-alloyed state.

7. A composite product according to claim 1 characterised in that all or part of the second powder or granular material is of the same composition as the first powder or granular material.

8. A composite product according to claim 1 characterised in that the annular zone contains one or more of the materials selected from MgO, CaO, $CaCO_3$, $CaC_2$, $Na_2CO_3$.

* * * * *